US007515169B2

(12) United States Patent
Komiya et al.

(10) Patent No.: US 7,515,169 B2
(45) Date of Patent: Apr. 7, 2009

(54) BEAM LIGHT SCANNING APPARATUS, IMAGE FORMING APPARATUS, AND BEAM LIGHT SCANNING METHOD

(75) Inventors: Kenichi Komiya, Kanagawa-Ken (JP); Koji Tanimoto, Shizuoka-Ken (JP); Daisuke Ishikawa, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 142 days.

(21) Appl. No.: 11/239,098

(22) Filed: Sep. 30, 2005

(65) Prior Publication Data

US 2006/0203077 A1 Sep. 14, 2006

(30) Foreign Application Priority Data

Mar. 11, 2005 (JP) ..... 2005-069856

(51) Int. Cl.
*B41J 2/44* (2006.01)

(52) U.S. Cl. ..... 347/247

(58) Field of Classification Search ..... 347/250, 347/247

See application file for complete search history.

(56) References Cited

U.S. PATENT DOCUMENTS 6,121,997 A * 9/2000 Fukushima ..... 347/261
6,452,690 B1 * 9/2002 Nakagawa ..... 358/1.15
6,462,855 B1 10/2002 Komiya et al.
6,806,894 B2 * 10/2004 Seki ..... 347/135
6,879,334 B2 * 4/2005 Ikeda ..... 347/235
2003/0001945 A1 * 1/2003 Maeda ..... 347/252
2003/0132940 A1 * 7/2003 Yamagata et al. ..... 345/505
2005/0024483 A1 * 2/2005 Ikeda ..... 347/249

FOREIGN PATENT DOCUMENTS

JP 2001-091872 A 4/2001

OTHER PUBLICATIONS

U.S. Appl. No. 11/237,902, filed Sep. 29, 2005, Ishikawa et al.
U.S. Appl. No. 11/239,097, filed Sep. 30, 2005, Komiya et al.

* cited by examiner

*Primary Examiner*—Huan H Tran
(74) *Attorney, Agent, or Firm*—Foley & Lardner LLP

(57) ABSTRACT

A beam light scanning apparatus capable of speeding up transfer of image data used for scan with a beam light while suppressing an increase of the parts cost. The beam light scanning apparatus includes a laser oscillator for emitting a beam light for scan, and a unit for processing and supplying image data of a target image in each line in a direction of main scan in response to a sync signal. The apparatus further includes a unit for acquiring the supplied image data after a certain time from generation of the sync signal, and a unit for controlling operation of the laser oscillator by a driving signal which is generated based on the acquired image data.

9 Claims, 12 Drawing Sheets

BEAM LIGHT SCANNING APPARATUS, IMAGE FORMING APPARATUS, AND BEAM LIGHT SCANNING METHOD

BACKGROUND OF THE INVENTION

1. Field of the Invention

The present invention relates to a beam light scanning apparatus for scanning a beam light, an image forming apparatus equipped with the beam light scanning apparatus, and a beam light scanning method. More particularly, the present invention relates to a beam light scanning apparatus, an image forming apparatus, and a beam light scanning method, which are suitable for, e.g., a copying machine and are capable of adjusting the transfer timing of image data in a transfer path extending until a driver for causing the beam light to be emitted.

2. Description of the Related Art

Recently, various types of image forming apparatuses, such as digital copying machines and laser printers, have been developed and put already into practice in which an image is formed with a combination of scanned exposure using a laser beam light (hereinafter referred to simply as a "beam light") and an electrophotographic process.

That type of image forming apparatus operates based on the principle that, as disclosed in, e.g., Patent Document 1; Japanese Unexamined Patent Application Publication No. 2001-91872, the surface of a single photoconductor drum is scanned and exposed at the same time using the beam light to form a single electrostatic latent image on the surface of the photoconductor drum, and the electrostatic latent image is transferred to a sheet of paper.

FIG. 10 shows generation of a driving signal applied to a laser driver when the electrostatic latent image is formed on the surface of the photoconductor drum based on the above-mentioned principle by driving a laser oscillator.

As shown in FIG. 10, a horizontal sync sensor 201 detects the passage timing of a scan beam light that is scanned by a polygon mirror (not shown) in the predetermined direction of main scan, to thereby generate a horizontal sync signal BD. The horizontal sync signal BD (hereinafter referred to simply as the "BD signal") is connected to a PWM circuit 203 of a laser control unit 202. The PWM circuit 203 outputs a line sync signal LSYNC (hereinafter referred to simply as an "LSYNC signal") in sync with the BD signal to an image data I/F 204.

Upon receiving the LSYNC signal, the image data I/F 204 outputs image data (DAT_IN) as input data to the laser control unit 202 in sync with an image data transfer clock (CLK_PIX) that is in turn in sync with the LSYNC signal.

The PWM circuit 203 receives the image data (DAT_IN) and issues a corresponding PWM output (DAT_OUT) to a laser driver 205. The laser driver 205 employs the PWM output (DAT_OUT) as a driving signal and drives a semiconductor laser 206 in accordance with the driving signal. The semiconductor laser 206 emits a laser beam in the form of pulsated light corresponding to the driving signal, and the beam light is scanned in the direction of main scan by an optical system including the polygon mirror. Accordingly, a latent image is formed per pixel on the surface of a photoconductor drum in the lengthwise direction thereof (i.e., in the direction of main scan). The photoconductor drum is rotated in sync with the scan of the beam light in the direction of main scan. At the next scan timing, therefore, the position of the scan line is moved to a next pixel position in the rotating direction of the photoconductor drum (i.e., in the direction of sub-scan), and formation of a latent image is similarly repeated in sync with the BD signal. As a result, a two-dimensional latent image is mapped on the surface of the photoconductor drum in both the direction of main scan and the direction of sub-scan. That latent image is then printed as an image.

FIGS. 11 and 12 are conceptual and detailed timing charts showing, by way of example, the above-described process of forming the PWM output (DAT_OUT).

A tailing edge of the LSYNC signal is outputted in sync with a leading edge of the BD signal. Also, the relative timing (time interval) Tsync between the leading edge of the BD signal and the trailing edge of the LSYNC signal is always constant. The image data I/F 204 transfers the image data (DAT_IN) to the laser control unit 202 in sync with the image data transfer clock (CLK_PIX) that is in turn in sync with the LSYNC signal (the image data transfer clock essentially serves as an image clock; namely, the frequency of the image clock is an image frequency per pixel). In accordance with the input image data (DAT_IN), the laser control unit 202 outputs an ON/OFF signal (DAT_OUT), i.e., the PWM output, to the laser driver 205 so that the laser 306 emits the beam light.

Thus, because the timings of generation of the BD signal and the LSYNC signal are always constant, the emission of the beam light from the laser is also in sync with the BD signal and an image can be formed without causing a deviation in the main scan.

With a recent tendency toward a "higher printing speed" and "finer image resolution", speedup of the image clock is demanded in many cases. Trying to speed up the image clock is equivalent to speedup of the transfer clock.

The speedup of the transfer clock faces a problem at the present. For example, the image data I/F 204 and an image processing unit 207 disposed upstream of the former start processing upon receiving the LSYNC signal and transfers the image data (DAT_IN) to the laser control unit 202 after completion of the processing. With the higher speed and the finer resolution (which inevitably lead to a higher rotation speed of the polygon mirror and a higher scan speed of the beam light), however, there may occur a trouble that the above-mentioned processing is not finished in time, whereby proper data cannot be transferred and a desired image cannot be formed.

One conceivable solution for overcoming such a problem is to execute the processing in the image processing unit 207 and the image data I/F 204 in advance, and to store the processed data in storage means in units of line (called a line memory). However, the line memory is expensive and the use of the line memory gives rise to another problem of increasing the parts cost of the apparatus. In the case using line memories for several lines, particularly, the parts cost is further increased correspondingly.

SUMMARY OF THE INVENTION

In view of the above-mentioned problems in the state of the art, an object of the present invention is to provide a beam light scanning apparatus, an image forming apparatus, and a beam light scanning method, which can speed up transfer of image data used for scan with a beam light while suppressing an increase of the parts cost, and which can realize a higher image printing speed and a finer image resolution.

To achieve the above object, a beam light scanning apparatus according to an aspect of the present invention includes a light emitting unit for emitting a beam light for scan; an image data supplying unit for processing and supplying image data of a target image in each line in a direction of main scan in response to a sync signal; a delayed acquisition unit for acquiring the image data supplied from the image data supplying unit after a certain time from generation of the sync signal; and a control unit for controlling operation of the light emitting unit by a driving signal which is generated based on the image data outputted from the delayed acquisition unit.

According to the present invention, it is possible to speed up transfer of image data, to increase an image printing speed, and to realize a finer image resolution, while suppressing an increase of the parts cost, with a relatively simple circuit configuration that when the image data of each line is transferred, acquisition of the image data is just delayed at a certain time.

DESCRIPTION OF THE PREFERRED EMBODIMENTS

Embodiments of the present invention will be described below with reference to the drawings.

First Embodiment

With reference to FIGS. 1-6, the following description is made of a digital copying machine that embodies not only a beam light scanning apparatus according to the present invention, but also an image forming apparatus equipped with the beam light scanning apparatus. The digital copying machine may be practiced as a standalone machine or as a part of an MFP system.

Figure 1:
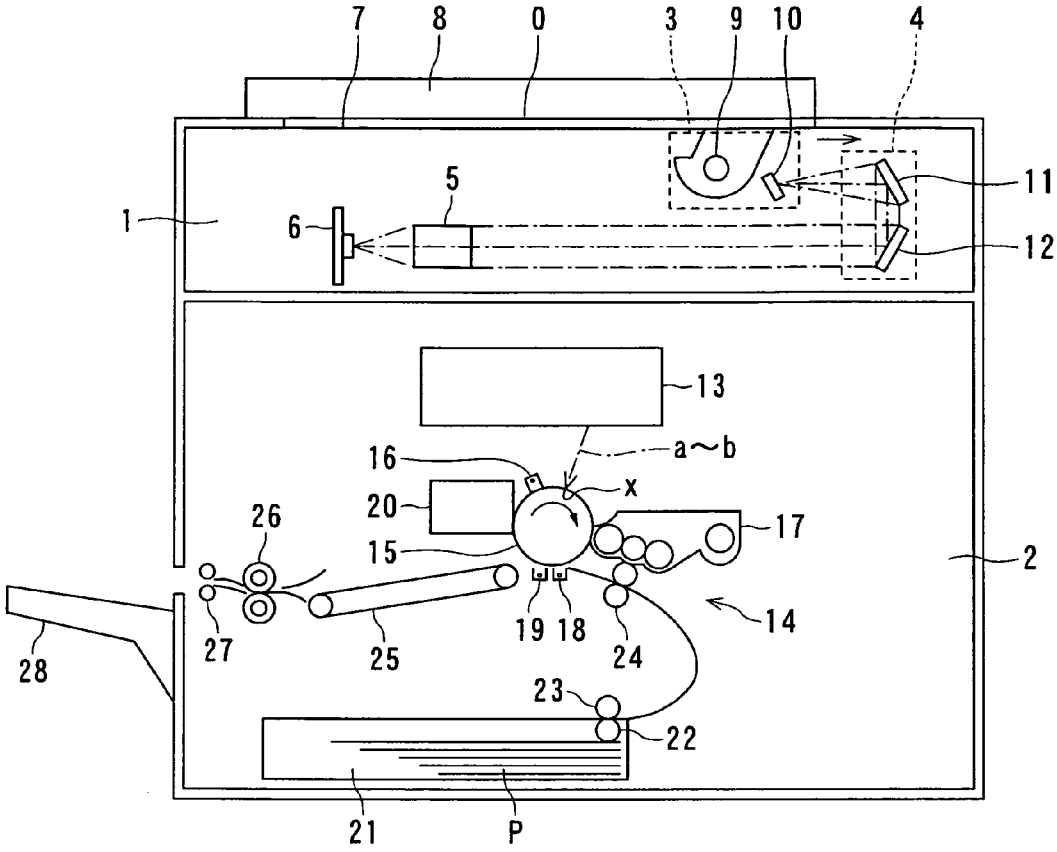
FIG. 1 is a schematic view for explaining an outline of a digital copying machine as one example of an image forming apparatus according to a first embodiment of the present invention.

FIG. 1 schematically shows the construction of the digital copying machine. The digital copying machine includes, for example, a scanner unit 1 serving as image reading means and a printer unit 2 serving as image forming means. The scanner unit 1 includes a first carriage 3 and a second carriage 4 which are movable in the direction indicated by an arrow, a focusing lens 5, a photoelectric transducer 6, etc.

In the construction shown in FIG. 1, an original document O is placed on a document platen 7 made of a transparent glass to face downward. The basis for placement of the document O is defined such that a center basis is given by the front right side of the document platen 7 as viewed in the direction of a shorter side of the document platen 7. The document O is pressed against the document platen 7 by a document fixing cover 8 attached to be capable of freely opening and closing.

The document O is illuminated by a light source 9, and a light reflected by the document O is collected onto a light receiving surface of the photoelectric transducer 6 through mirrors 10, 11 and 12 and the focusing lens 5. The first carriage 3 mounting the light source 9 and the mirror 10 thereon and the second carriage 4 mounting the mirrors 11, 12 thereon are moved at a relative speed of 2:1 so that an optical path length is held constant. The first carriage 3 and the second carriage 4 are moved by a carriage driving motor (not shown) in the direction toward the right from the left, as viewed on FIG. 1, in sync with a read timing signal.

In such a way, an image of the document O placed on the document platen 7 is sequentially read by the scanner unit 1 line by line. A read output is converted in an image processing unit 57 (see FIG. 3) to a digital image signal of, e.g., 8 bits, which represents light and dark of the image.

The printer unit 2 includes an optical system unit 13 and an image forming section 14 capable of forming an image on a sheet of paper P, i.e., a medium on which the image is to be formed, according to the electrophotographic process in combination with the optical system unit 13. More specifically, an image signal read by the scanner unit 1 from the document O is processed by the image processing unit 57 (see FIG. 3) and then converted to a laser beam light (hereinafter referred to simply as a "beam light") emitted from a semiconductor laser oscillator 31 (see FIG. 2). This embodiment employs, by way of example, a single beam optical system including one semiconductor laser oscillator.

Although details of the optical system unit 13 will be described later with reference to FIG. 2, one semiconductor laser oscillator 31 disposed in the optical system unit 13 is operated so as to emit a beam light in accordance with a laser modulation signal outputted from the image processing unit 57, and the emitted beam light is reflected by a polygon mirror to become a scan light that is outputted externally of the optical system unit 13.

The beam light irradiated from the optical system unit 13 is focused as the scan light in the form of a spot having a required resolution at an exposure position X (see FIG. 1) on a photoconductor drum 15, which serves as an image carrier, for performing scan and exposure line by line. As a result, an electrostatic latent image corresponding to the image signal is formed on the surface of the photoconductor drum 15.

Around the photoconductor drum 15, there are disposed an electrical charger 16 for charging the drum surface with electricity, a developing unit 17, a transfer charger 18, a peeling-off charger 19, a cleaner 20, and so on. The photoconductor drum 15 is rotated at a predetermined outer circumferential speed by a driving motor (not shown) and is charged with electricity by the electrical charger 16 disposed opposite to the drum surface. At the exposure position X on the photoconductor drum 15 thus charged with electricity, the beam light (scan light) is focused in the form of a spot.

The electrostatic latent image formed on the surface of the photoconductor drum 15 is developed with a toner (developer) supplied from the developing unit 17. With the rotation of the photoconductor drum 15 including the toner image formed by the development, the toner image is transferred at a transfer position by the transfer charger 18 to the sheet of paper P that is supplied at the matched timing from a paper supply system.

In the paper supply system, sheets of paper P set in a paper supply cassette 21 disposed at the bottom are individually separated and supplied one by one with a combination of a paper feed roller 22 and a separating roller 23. After reaching a register roller 24, the sheet of paper P is further fed to the transfer position at the predetermined timing. Downstream of the transfer charger 18, there are disposed a paper conveying mechanism 25, a fusing unit 26, and a paper ejection roller 27 for ejecting the sheet of paper P on which the image has been formed. The toner image transferred to the sheet of paper P is fused and fixed by the fusing unit 26. Then, the sheet of paper P is ejected through a paper ejection roller 27 onto an ejected paper tray 28 disposed outside the machine.

The photoconductor drum 15 from which the toner image has been transferred to the sheet of paper P is returned to an initial state after the toner remaining on the drum surface has been removed by the cleaner 20, followed by coming into a standby state for a next cycle of image formation.

By repeating the above-described process steps, the image forming operation is successively performed.

Thus, the document O placed on the document platen 7 is read by the scanner unit 1, and read information is recorded as a toner image on the sheet of paper P after being subjected to a series of the process steps in the printer unit 2.

The optical system unit 13 will be described below.

Figure 2:
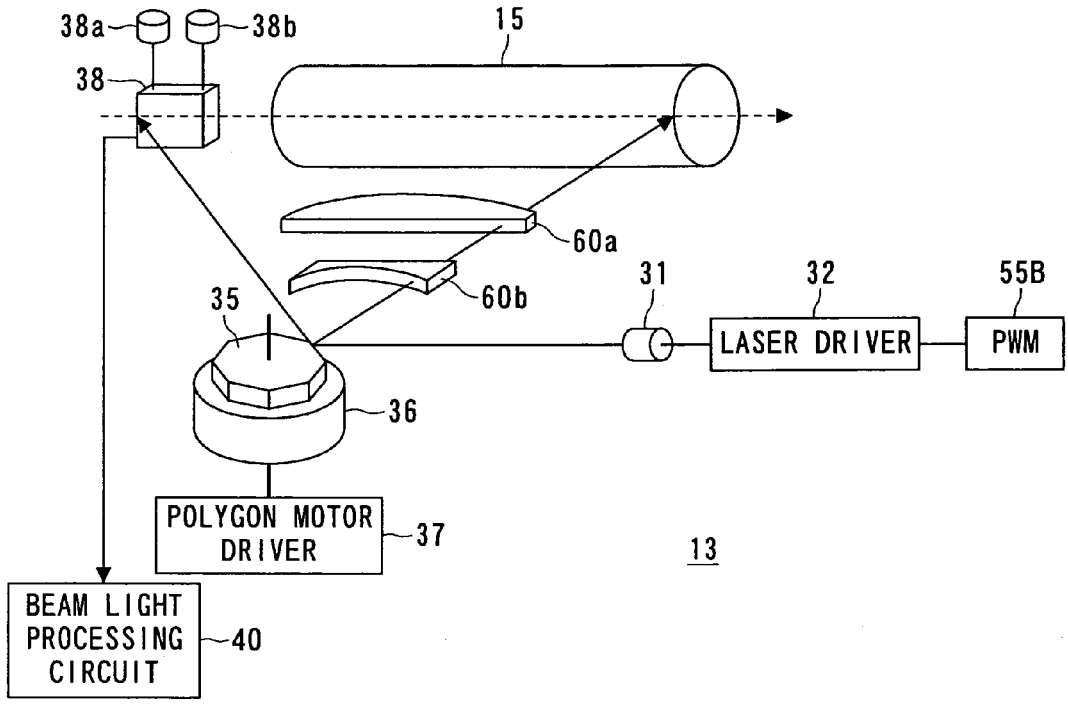
FIG. 2 is a schematic view for explaining an optical system of the image forming apparatus according to the first embodiment.

FIG. 2 shows components of the optical system unit 13 and the positional relationships between those components and the photoconductor drum 15. The optical system unit 13 includes, as mentioned above, the laser (semiconductor laser oscillator) 31 serving as one beam light emitting means. The laser 31 emits the beam light to perform the image formation in units of one scan line. The laser 31 is driven by a laser driver 32, and the beam light emitted from the laser 31 impinges upon a polygon mirror 35, i.e., a multi-faced rotating mirror, after passing through a collimator lens (not shown).

The polygon mirror 35 is rotated at a constant speed by a polygon motor 36 that is driven by a polygon motor driver 37. Therefore, the light reflected by the polygon mirror 35 is scanned in a certain direction at an angular speed determined depending on the rotation speed of the polygon motor 36. The beam light scanned by the polygon mirror 35 passes through an f-θ lens (not shown) having a particular f-θ characteristic. As a result, the beam light scans a light receiving surface of a beam light detector 38 and the surface of the photoconductor drum 15 at a constant speed. The beam light detector 38 functions as beam light position detecting means, beam-light passage timing detecting means, and beam light power detecting means.

The laser driver 32 includes an APC circuit so that the laser 31 is always steadily operated to emit the beam light at a power level of the emitted beam light set by a main control unit (CPU) 51 (described later).

Also, the beam light detector 38 is provided with adjustment motors 38*a*, 38*b* for adjusting the mount position of the beam light detector 38 and the inclination thereof with respect to the scan direction of the beam light.

The beam light detector 38 detects, as mentioned above, the passage position, the passage timing and the power (light intensity) of the beam light scanning the surface of the photoconductor drum 15. The beam light detector 38 is disposed near one end of the photoconductor drum 15 such that the light receiving surface of the beam light detector 38 is equivalent to the surface of the photoconductor drum 15 from the positional aspect. Control of the laser 31 and control of the light emission timing (i.e., control of the image formation position in the direction of main scan) are executed in accordance with a detected signal from the beam light detector 38. In particular, the control of the light emission timing includes delay control in transfer of image data according to the present invention. This delay control is executed using a horizontal sync signal (BD) outputted from the beam light detector 38 with the detection of the passage position of the beam light.

The beam light detector 38 is connected to a beam light processing circuit 40 for producing signals to execute the above-mentioned control. The beam light processing circuit 40 receives various detected signals from the beam light detector 38 and supplies detection pulse signals (including the horizontal sync signal (BD)), which represents the passage position and the passage timing of the beam light, to the main control unit 51 and a laser control unit 55 described later.

A control system will be described below.

Figure 3:
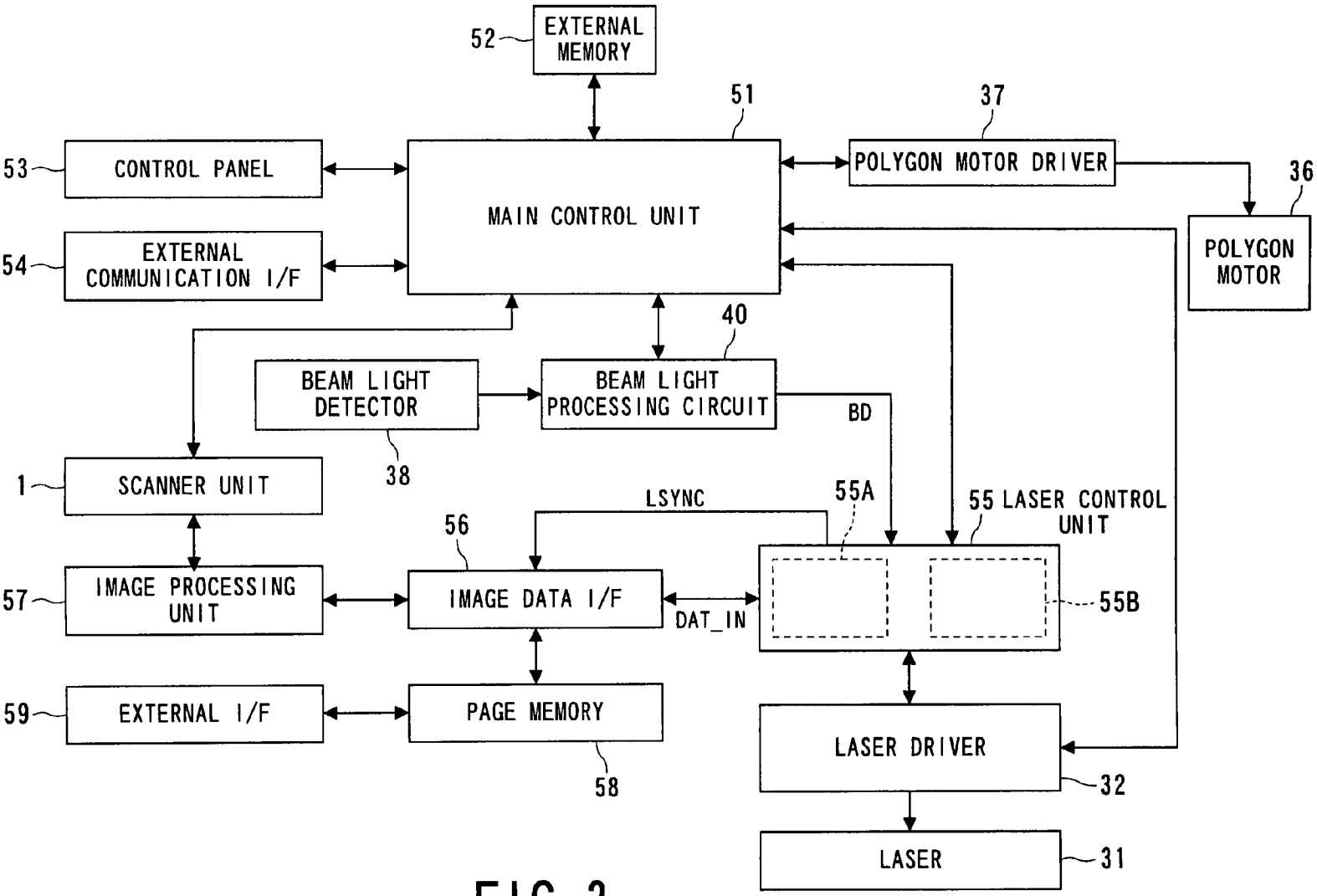
FIG. 3 is a block diagram for explaining an outline of a control system according to the first embodiment.

FIG. 3 shows the control system primarily executing control of the single beam optical system. The control system includes the main control unit 51 for executing overall electric control in the copying machine. The main control unit 51 includes, for example, a CPU, a memory, and a clock circuit (all not shown). Also, connected to the main control unit 51 are an external memory 52, a control panel 53, an external communication interface (I/F) 54, the laser driver 32, the polygon motor driver 37, the beam light processing circuit 40, the scanner unit 1, and the laser control unit 55 each in a communicable manner.

Among those components, the laser control unit 55 is connected to not only the beam light processing circuit 40, but also to an image data I/F 56, as shown in FIG. 3.

The image processing unit 57 is connected to the laser control unit 55 via the image data I/F 56 so that the image data can be outputted to the laser control unit 55. Further, an external I/F 59 is connected to the image data I/F 56 via a page memory 58.

In copying operation, the image of the document O set on the document platen 7 is read by the scanner unit 1 and sent to the image processing unit 57. The image processing unit 57 performs predetermined known processing, such as a shading modification, various filtering processes, a degradation process and a gamma modification, and then outputs processed image data to the image data I/F 56.

The image data outputted from the image processing unit 57 is sent to the image data I/F 56. The image data I/F 56 sends the image data to the laser control unit 55.

Figure 4:
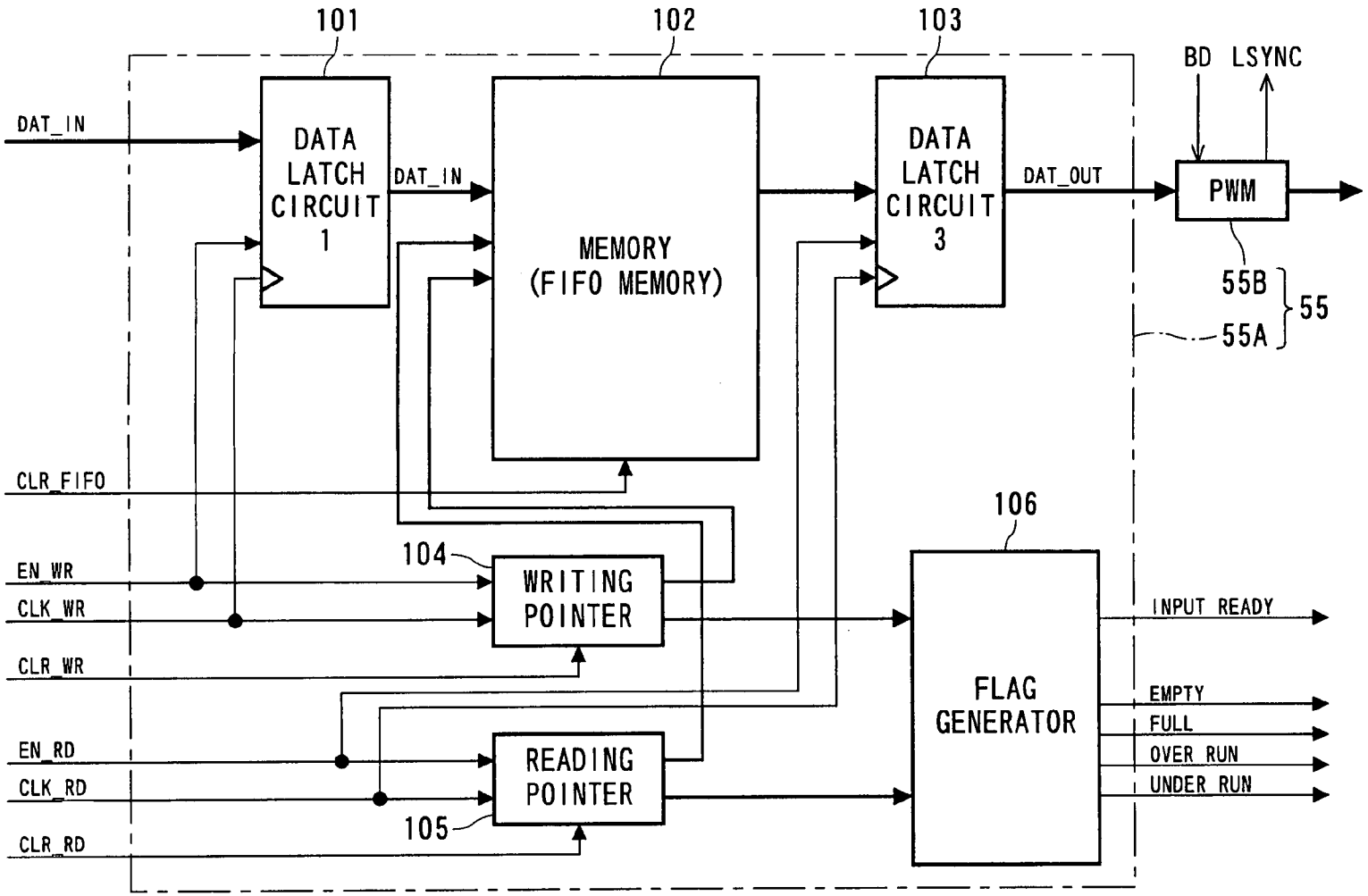
FIG. 4 is a block diagram showing the configuration of a laser control unit in the control system according to the first embodiment.

The laser control unit 55 includes, as shown in FIG. 4, a delay control circuit 55A for transferring the image data after a delay, which has been inputted via the image data I/F 56, and a PWM circuit 55B for executing PWM on the image data delayed by the delay control circuit 55A, to thereby produce a modulated signal.

Among those components, the delay control circuit 55A includes a data latch circuit 101 for writing, a memory 102 capable of writing and reading data on the FIFO basis, a data latch circuit 103 for reading, a writing pointer 104 for use in data write control (regarding the number of written data and the write positions), a reading pointer 105 for use in data read control (regarding the number of read data and the read positions), and a flag generator 106 for generating flag information indicating the state of the delay control.

Image data (DAT_IN), a write enable signal (EN_WR), and a write data clock (CLK_WR) are applied to the data latch circuit 101 for writing. A read enable signal (EN_RD) and a read data clock (CLK_RD) are applied to the data latch circuit 103 for reading. The write enable signal (EN_WR) and the write data clock (CLK_WR) are also applied to the writing pointer 104. The read enable signal (EN_RD) and the read data clock (CLK_RD) are also applied to the reading pointer 105.

With such an arrangement, the image data (DAT_IN) is latched by the data latch circuit 101 in sync with the write enable signal (EN_WR) and the write data clock (CLK_WR). The latched data is written into the memory 102 in accordance with an output value of the writing pointer 104. On the other hand, the image data is read out of the memory 102 in accordance with an output value of the reading pointer 105 and in sync with the read enable signal (EN_RD) and the read data clock (CLK_RD). The read image data is latched, as image data (DAT_OUT) having been subjected to the delay control, by the data latch circuit 103 for data reading. The latched data is transferred to the PWM circuit 55B as the image data (DAT_OUT) having been subjected to the delay control.

In this embodiment, the write enable signal (EN_WR), the write data clock (CLK_WR), the read enable signal (EN_RD), and the read data clock (CLK_RD) are supplied from the main control unit 51. However, a circuit for generating those enable signals and clocks may be disposed in the laser control unit 55.

The flag generator 106 generates, as mentioned above, flags indicating the states of the memory 102 as follows:

EMPTY: the difference between the writing pointer value and the reading pointer value is 0 (memory is empty)

FULL: the writing pointer value is matched with a memory maximum value (memory is full)

OVER RUN: the writing pointer value exceeds the memory maximum value

UNDER RUN: the reading pointer value exceeds a memory lower limit value

INPUT READY: state other than the above

The signals indicating those flag states are sent to the main control unit 51 and are used for control in the main control unit 51.

In addition to the above-described configuration, as shown in FIG. 4, a memory clear signal (CLR_FIFO) is supplied to the memory 102, a writing pointer clear signal (CLR_WR) is supplied to the writing pointer 104, and a reading pointer clear signal (CLR_RD) is supplied to the reading pointer 105. Although those clear signals (CLR_FIFO, CLR_WR, CLR_RD) are supplied from the main control unit 51 in this embodiment, a circuit for generating those clear signals may be disposed in the laser control unit 55.

Among those clear signals, the memory clear signal (CLR_FIFO) is a signal for clearing the memory 102. When this signal is asserted by the memory 102, the data stored in the memory 102 is cleared (e.g., all zeros). The writing pointer clear signal (CLR_WR) is a signal for clearing the data in the writing pointer 104. When this signal is asserted by a control section of the writing pointer 104, the written data held by the writing pointer 104 is reset to zero. Further, the reading pointer clear signal (CLR_RD) is a signal for clearing the data in the reading pointer 105. When this signal is asserted by a control section of the reading pointer 105, the read data held by the reading pointer 105 is reset to zero.

The reason why those clear signals are used will be described below. The memory 102 is controlled by the writing pointer 104 and the reading pointer 105 such that writing and reading are held in equivalent relation to each other (i.e., data is read in the same amount as data written). At that time, due to noises, etc. superimposed on the clocks (CLK_WR and CLK_RD), there may occur the case where writing and reading are not in equivalent relation to each other. Such a case accompanies a risk of causing an error, e.g., an OVER RUN error or an UNDER RUN error, depending on the memory capacity and the number of data. These errors lead to deterioration of image quality because the data read out of the memory 102 differ from the predetermined data and a desired image is not resulted. In that case, therefore, those clear signals are asserted to return the memory and the pointers to their initial states, followed by starting the image forming operation again.

Also, in the case free from the above-mentioned errors, it is possible to minimize the influence of the errors (deterioration of image quality) by periodically clearing the memory 102 and the pointers 104, 105.

One example most effective in achieving the above purpose is a method of clearing the memory 102 and the pointers 104, 105 whenever one line has been formed. Even if the equivalent relation between writing and reading is lost due to abrupt noise, etc., the resulting influence appears only in one line. Such a method can be realized by arranging the circuit connections so as to make each of the memory clear signal (CLR_FIFO), the writing pointer clear signal (CLR_WR), and the reading pointer clear signal (CLR_RD) outputted in sync with the BD signal. As a result, the memory 102 and the pointers 104, 105 are cleared per line (namely, whenever the BD signal is outputted).

As another example, it is also effective to clear the memory 102 and the pointers 104, 105 whenever the page printing operation is completed. For example, the memory 102 and the pointers 104, 105 are cleared when an EOP signal is at a low level. In other words, the circuit connections are arranged so as to clear the memory 102 and the pointers 104, 105 within an interval between two sheets of paper (sheet interval) in continuous printing operation, and to clear them in periods before and after one sheet of paper in intermittent printing operation. In this example, since a sufficient time margin is ensured for the clear timing, the main control unit (CPU) 51 may also be used to assert the clear signals.

The PWM circuit 55B shown in FIG. 4 executes PWM on a pulse signal in accordance with the image data transferred via the delay control circuit 55A, to thereby produce a PWM modulated signal. The PWM modulated signal is sent as a driving signal to the laser driver 32. The laser driver 32 drives the laser 31 in accordance with the driving signal.

Returning to FIG. 3, the control panel 53 is a man-machine interface allowing an operator to, for example, start the copying operation and set the number of copies.

The digital copying machine of this embodiment can operate so as to not only perform the copying operation, but also to form an image by using image data inputted from the outside via the external I/F 59 that is connected to the page memory 58. The image data inputted via the external I/F 59 is temporarily stored in the page memory 58 and then sent to the laser control unit 55 via the image data I/F 56.

Further, when the digital copying machine of this embodiment is controlled from the outside via a network, for example, the external communication I/F 54 takes the role of the control panel 53.

The polygon motor driver 37 is a driver for driving the polygon motor 36 to rotate the polygon mirror 35 for scanning the beam light. The main control unit 51 can control the polygon motor driver 37 so as to start and stop the rotation and to change the rotation speed. The rotation speed is changed as required, for example, when the rotation speed should be reduced from a predetermined speed at the time of confirming the passage position of the beam light by the beam light detector 38.

The laser driver 32 has the functions of not only causing the laser beam to be emitted in accordance with the modulated signal supplied from the laser control unit 55 in sync with scan of the beam light as described above, but also forcibly operating the laser 31 to emit the beam light regardless of the image data in response to a forced light emission signal from the main control unit 51.

Also, the main control unit 51 sets, for the laser driver 32, the power for operating the laser 31 to emit the beam light. The setting of the light emission power is modified depending on, e.g., changes of process conditions.

The memory 52 stores information necessary for the control. For example, the memory 52 stores characteristics (amplifier offset value) of a circuit for detecting the passage position of the beam light and the order of arrival of beam light so that the optical system unit 13 can be brought into a state ready for the image formation immediately after power-on.

The operation and advantages of this embodiment will be described below while laying a focus on the operation and advantages of the laser control unit 55.

The beam light detector 38 serving also as the horizontal sync sensor detects the passage timing of the scan beam light that is scanned by the polygon mirror in the direction indicated by an arrow. In response to the detection, the beam light processing circuit 40 generates a horizontal sync signal (BD).

The BD signal is further supplied to the PWM circuit 55B of the laser control unit 55. Upon receiving the BD signal, the PWM circuit 55B outputs a line sync signal (LSYNC) to the image data I/F 56 in sync with the BD signal.

Upon receiving the LSYNC signal, the image data I/F 56 outputs the image data (DAT_IN) to the delay control circuit 55A of the laser control unit 55 in sync with an image data transfer clock (not shown) that is in turn in sync with the LSYNC signal. Note that, in FIG. 4, the write data clock (CLK_WR) corresponds to the image data transfer clock and DAT_IN represents the image data.

The delay control circuit 55A writes the image data (DAT_IN) in the FIFO memory 102 in an amount within a storable capacity thereof. Then, the delay control circuit 55A reads the image data (DAT_IN) stored in the memory 102 in sync with the read data clock (CLK_RD) and sends read image data (DAT_OUT) to the PWM circuit 55B. The PWM circuit 55B outputs, as a driving signal, a PWM signal modulated in accordance with the received image data (DAT_OUT). The driving signal is outputted to the laser driver 32, whereupon the laser driver 32 drives the laser 31 in accordance with the PWM-modulated driving signal to emit the laser beam in the form of pulsated light.

Regarding the transfer of the image data (DAT_IN) to the PWM circuit 55B, this embodiment is featured in the data writing and reading process executed in the delay control circuit 55A. The cycle (frequency) of the write data clock (CLK_WR) serving as the data transfer clock for writing the input data, i.e., the image data (DAT_IN), in the FIFO memory 102 and the cycle (frequency) of the read data clock (CLK_RD) defining the timing of reading the image data (DAT_IN), which has been written in the FIFO memory 102, out of the FIFO memory 102 are not always matched with each other. In other words, assuming the frequency of the write data clock (CLK_WR) to be Fw [MHz] and the frequency of the read data clock (CLK_RD) to be Fr [MHz], the data writing and reading processes are set so as to hold the relationship of $Fw \leqq Fr$.

That feature means that the processing in the upstream side of the system including the image data I/F 56 is executed at the frequency Fw, and the processing in the side downstream of the PWM circuit 55B of the laser control unit 55, which actually takes part in the image formation, is executed at the frequency Fr. Stated another way, the image data (DAT_IN) is processed at a relatively low speed in the upstream side, and the actual image forming process is executed in the downstream side at a stage where the processing in the upstream side has advanced to some extent.

Thus, this embodiment is able to realize a processing system writing the image data (DAT_IN) of each line at a relatively low speed and reading it at a relatively high speed with respect to the laser control unit 55. In such a process, the FIFO memory 102 functions as timing delay means to delay the read timing.

Figure 5:
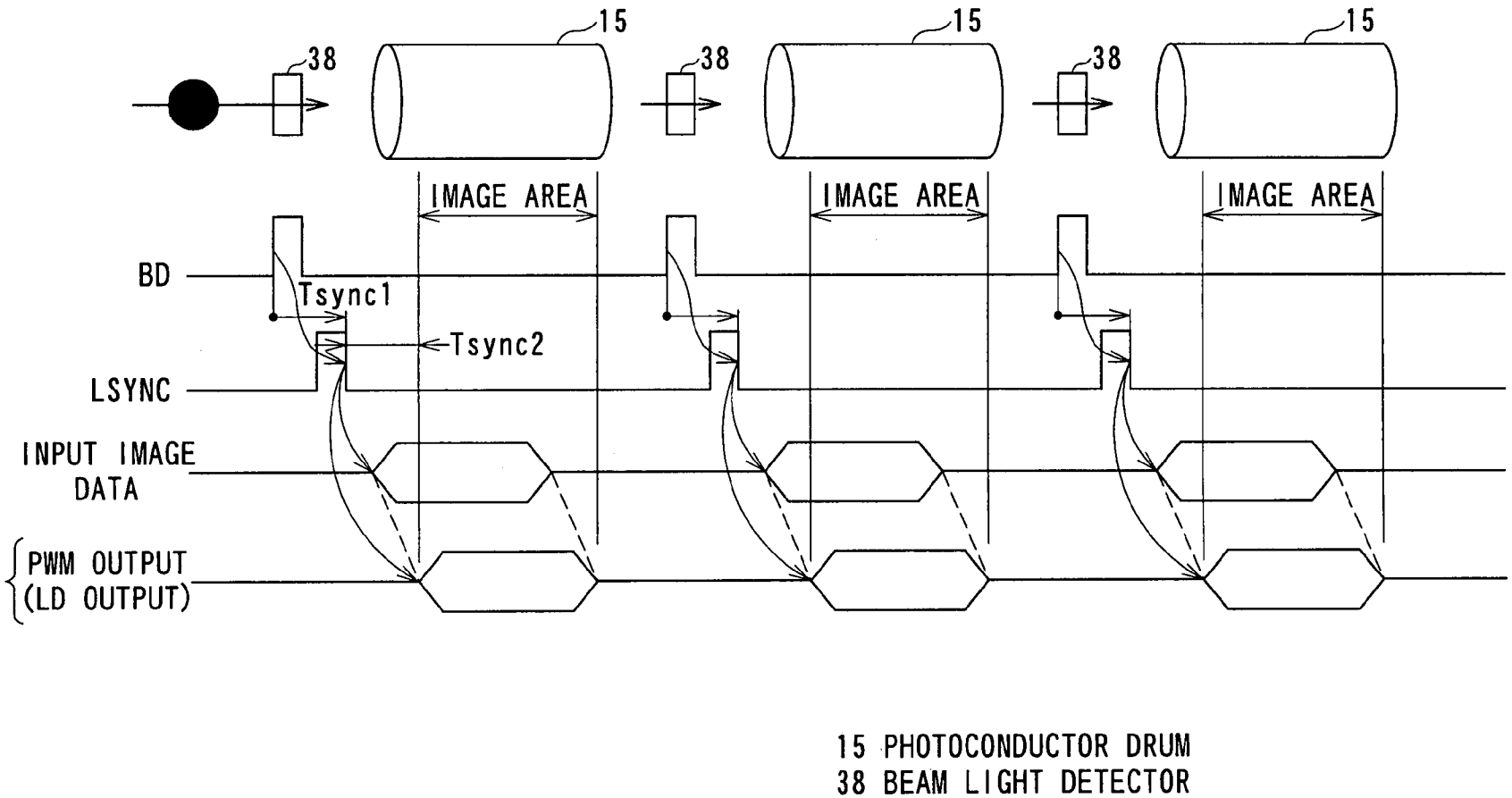
FIG. 5 is a timing chart for explaining the concept of delay control executed in the first embodiment.

FIG. 5 shows basic time relationships among the BD signal, the LSYNC signal, the image data (DAT_IN) before delay, and the PWM output (PWM modulated signal, i.e., driving signal) resulting from the image data after delay when the beam light reflected by the polygon mirror 35 scans an image area on the photoconductor drum 15.

Figure 6:
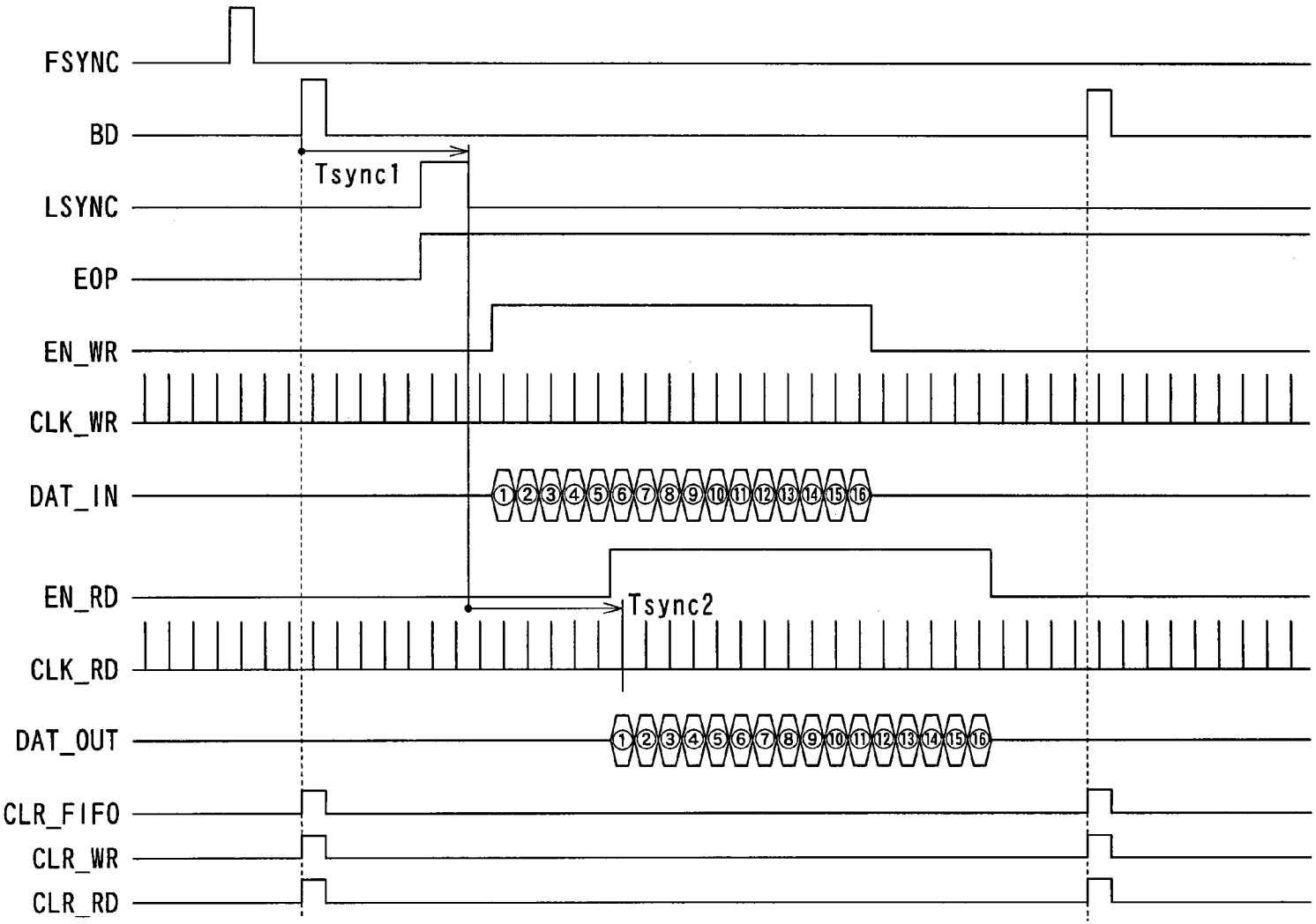
FIG. 6 is a timing chart for explaining details of the delay control executed in the first embodiment.

The time relationships shown in FIG. 5 can be depicted in more detail as a timing chart of FIG. 6. The following description is made with reference to FIGS. 5 and 6, as well as the block diagram of FIG. 3.

Upon receiving the BD signal, the PWM circuit 55B outputs the LSYNC signal (line sync signal) to the image data I/F 56 in sync with the BD signal (horizontal sync signal) after a certain delay time Tsync1. Upon receiving the LSYNC signal, the image data I/F 56 makes the write enable signal (EN_WR) effective for writing the data into the FIFO memory 102. Correspondingly, the image data I/F 56 transfers the image data (DAT_IN) to the data latch 101 for the FIFO memory 102 in sync with the data transfer clock (i.e., the write data clock CLK_WR) that is in turn in sync with the LSYNC signal. The data latch 101 latches the data in response to the data transfer clock (CLK_WR).

The write enable signal (EN_WR) and the data transfer clock (CLK_WR) are also connected to the writing pointer 104. The writing pointer 104 executes writing of the image data (DAT_IN) into the memory in such a manner that the data latched by the data latch 101 is written into the memory 102. Thus, the writing pointer 104 manages the number and order (positions) of the written data.

On the other hand, the reading pointer 105 executes management of reading of the image data, which has been written into the memory 102, regarding the number and order (positions) of the read data. The read enable signal (EN_RD) and the read data clock (CLK_RD) are supplied to the reading pointer 105. Thus, in this embodiment, the read data clock (CLK_RD) corresponds to the image formation clock.

When the image data I/F 56 outputs the read enable signal (EN_RD) in sync with the LSYNC signal, the read data clock (CLK_RD) in sync with the LSYNC signal is applied to the reading pointer 105. Responsively, the reading pointer 105 reads the image data, which has been temporarily stored in the memory 102, in the same order as the written data and then transfers it, as the image data (DAT_OUT), to the PWM circuit 55B.

A delay amount in reading of the image data (i.e., between inputting and outputting of the image data) can be adjusted by controlling the timing at which the read enable signal (EN_RD) is outputted, exactly speaking, a delay time Tsync2 from the time of the tailing edge of the LSYNC signal to the timing at which the read clock signal is made effective by the reading pointer 105.

The delay time Tsync2 can be set in the range of:

0<Tsync2<maximum value of memory capacity

In principle, the maximum value of the memory capacity means a maximum value of the storage capacity of the memory 102. Because of delays (such as a delay in the writing operation and a delay in the reading operation) occurred in memory peripheral circuits, however, an actually settable delay time is given as a time (or the number of clocks corresponding to the time) obtained by subtracting those delays from the maximum value of the memory capacity. A value set as the delay time depends on the circuit configuration. For example, when the number of pixels per line is 8000 (FIG. 6 shows the number of pixels just by way of illustration), the memory 102 has a capacity of 512 pixels (maximum value). A memory having a capacity equal to or over 1 line is generally called a line memory. A circuit configuration using such a line memory is not intended by the delay control according to the present invention. With the delay control intended by the present invention, the delay is performed within the same line.

The setting of the delay time Tsync2 enables the read timing to be set in consideration of a state where the processing in the upstream side has progressed to some extent. The read timing represents a point in time at which the processing of the image data of each line has been advanced by the image processing unit 57 and the processed image data has been written in the FIFO memory 102 to some extent. Upon reaching that read timing, therefore, the reading of the image data from the FIFO memory 102 is started to form an actual image of each line.

Also, because the above-mentioned read timing of the image data is in sync with the BD signal and the LSYNC signal, there occurs no image deviation in the direction of main scan during the image formation for each line.

Additionally, the EOP signal shown in FIG. 6 represents a signal indicating an image area in the direction of sub-scan (paper feed direction) perpendicular to the direction of main scan in which the beam light is scanned (i.e., a signal indicating an image area in one page). Lines are formed in number corresponding to the number of LSYNC signals outputted in a period during which the EOP signal is effective (i.e., it takes a high level). The EOP signal is also supplied from, e.g., the main control unit 51.

With this embodiment, as described above, image data of a target image in each line in the direction of main scan is processed and supplied in response to the LSYNC signal. On the other hand, acquisition of the image data is started after the certain time Tsync2 from the LSYNC signal. Hence, the image data can be reliably acquired and used to drive the light emitting means.

Therefore, even when the transfer speed of the image data is increased, the image data can be acquired after the image processing unit 57 and the image data I/F 56 have finished the processing of the image data of each line and supply of the processed image data has been positively started, by setting the delay time Tsync2 to a certain appropriate value. Stated another way, in spite of speedup of the clock signal i.e., speedup of the transfer clock for the image data, it is possible to reliably avoid the trouble that the data transfer to the other processing circuit (such as the PWM circuit) in the downstream side is started before the processing of the image data of each line is finished in a completed manner or before the supply of the processed image data is started. Accordingly, even when the transfer clock is sped up, the image data of each line subjected to the image processing can be transferred without missing. As a result, the transfer of the image data can be sped up to increase the image printing speed and to realize a finer resolution of the image, while suppressing an increase of the parts cost, with a relatively simple circuit configuration just enough to delay acquisition of the image data of each line by a certain time when the image data is transferred.

Conversely speaking, even when the image formation clock is sped up with the "higher printing speed" and "finer image resolution", it is possible to reliably avoid the problem that the provision of the delay control circuit 55A between the image data I/F 56 and the PWM circuit 55B makes the processing in the image processing unit 57 and the image data I/F 56 not finished in time, and a desired image cannot be formed because of a mismatch in data read timing and data consistency.

On the other hand, since the read delay control for the image data is performed during transfer of one line, an FIFO memory is just required with no need of using a relatively expensive line memory that is employed in the related art. Consequently, the cost of parts necessary in the copying machine can be suppressed.

Second Embodiment

A second embodiment of the image forming apparatus integrally equipped with the beam light scanning apparatus according to the present invention will be described with reference to FIGS. 7-9. The image forming apparatus of this second embodiment also embodies the beam light scanning method according to the present invention.

Note that, in the following, the same or equivalent components as or to those in the first embodiment are denoted by the same symbols, and a description of those components is omitted or simplified here.

As with the first embodiment, the image forming apparatus of the second embodiment is practiced as a digital copying machine functioning as a part of an MFP system.

Comparing with the first embodiment, the image forming apparatus of the second embodiment is featured in that the processing speed (processing frequency Fw [MHz]) in the upstream-side system including the image data I/F 56 can be reduced from the processing speed (processing frequency Fr [MHz]) in the system downstream of the PWM circuit 55B, which actually takes part in the image formation. In practice, Fw=½×Fr is feasible. As one example, Fw=50 MHz and Fr=100 MHz are set.

Figure 7:
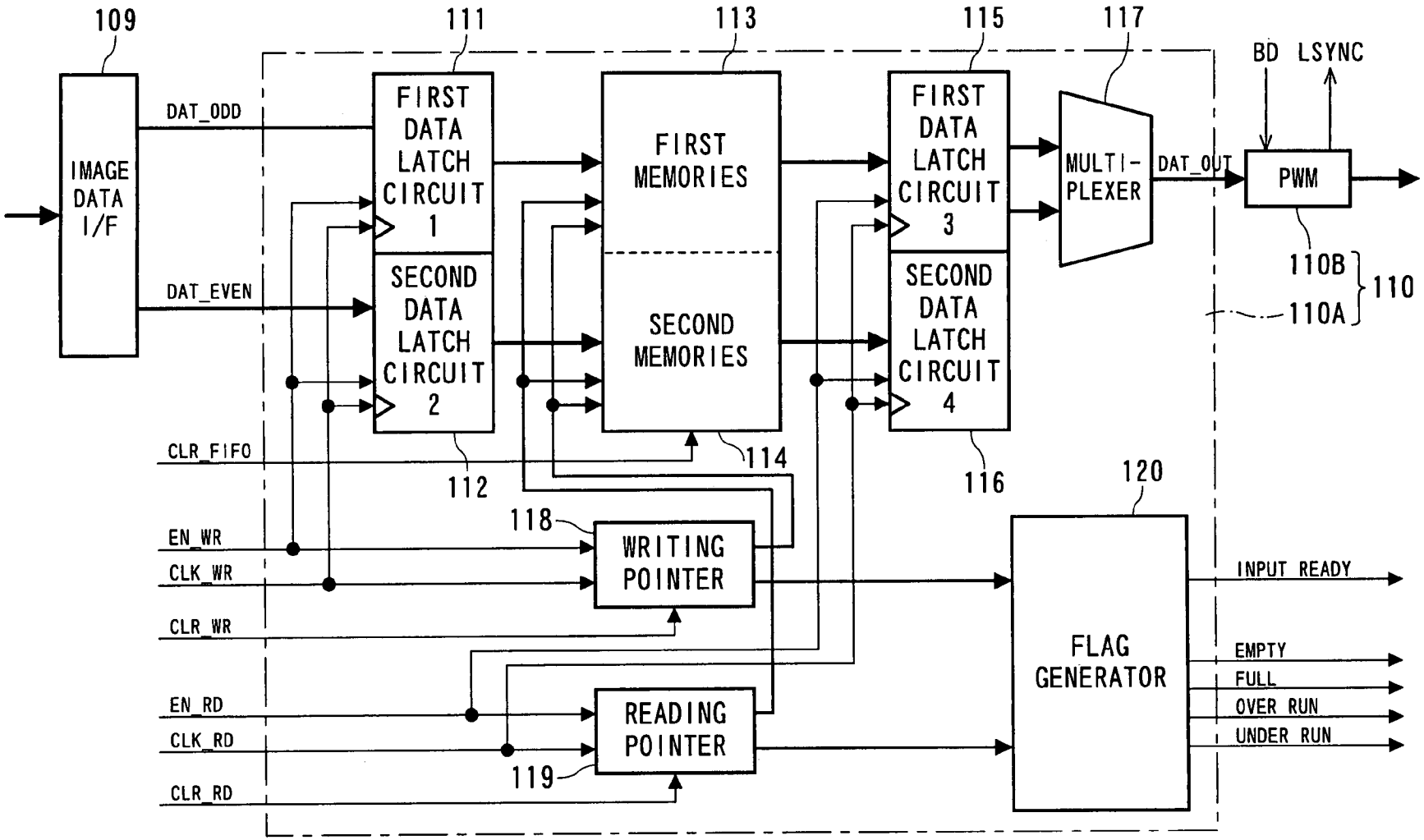
FIG. 7 is a block diagram showing the configuration of a laser control unit in a control system according to a second embodiment of the present invention.

To realize that feature, as shown in FIG. 7, this embodiment includes an image data I/F 109 and a laser control unit 110. The image data I/F 109 is connected to the above-described image processing unit 57 in communicable manner. Therefore, the image data (DAT_IN) is time-serially transferred from the image processing unit 57 to the image data I/F 109 in an alternate order of odd-numbered pixels and even-numbered pixels. The image data I/F 109 having received the image data (DAT_IN) outputs the image data while distributing it into two channels, i.e., a train of image data (DAT_ODD) consisted of only the odd-numbered pixels and a train of image data (DAT_EVEN) consisted of only the even-numbered pixels.

The laser control unit 110 includes, as shown in FIG. 7, a delay control circuit 110A and a PWM circuit 110B. The PWM circuit 110B functions in the same manner as the PWM circuit 55B in the first embodiment.

On the other hand, the delay control circuit 110A includes first and second data latch circuits 111, 112 for writing, first and second memories 113, 114 capable of writing and reading data on the FIFO basis, first and second data latch circuits 115, 116 for reading, a multiplexer 117 for combining different trains of data, a writing pointer 118 for use in data write control, a reading pointer 119 for use in data read control, and a flag generator 120 for generating flag information indicating the state of the delay control.

Among those components, the first and second data latch circuits 111, 112 for writing are connected respectively to the first and second memories 113, 114. Then, the first and second memories 113, 114 are connected respectively to the first and second data latch circuits 115, 116 for reading. Further, the first and second data latch circuits 115, 116 for reading are connected to the multiplexer 117 having two inputs and one output.

A write enable signal (EN_WR) and a write data clock (CLK_WR) are applied to each of the first and second data latch circuits 111, 112 for writing. A read enable signal (EN_RD) and a read data clock (CLK_RD) are applied to each of the first and second data latch circuits 115, 116 for reading. The write enable signal (EN_WR) and the write data clock (CLK_WR) are also applied to the writing pointer 118. The read enable signal (EN_RD) and the read data clock (CLK_RD) are also applied to the reading pointer 119.

With that arrangement, the first and second data latch circuits 111, 112 for writing latch the image data (DAT_ODD, DAT_EVEN) from the image data I/F 109 in sync with the write enable signal (EN_WR) and the write data clock (CLK_WR). Then, the image data (DAT_ODD, DAT_EVEN) latched by the first and second data latch circuits 111, 112 are written into the first and second memories 113, 114 in accordance with an output value of the writing pointer 118. Further, the first and second data latch circuits 115, 116 for reading latch the image data (DAT_ODD, DAT_EVEN) from the first and second memories 113, 114 in accordance with an output value of the reading pointer 119 and in sync with the read enable signal (EN_RD) and the read data clock (CLK_RD). In this latching step, i.e., in the reading step, the train of the odd-numbered pixel data and the train of the even-numbered pixel data are separately subjected to the delay control as described later.

The image data (DAT_ODD, DAT_EVEN) read out of the first and second data latch circuits 115, 116 are sent to the multiplexer 117 at respective predetermined timings. With the input alternately switching function of the multiplexer 117, therefore, the image data (DAT_ODD, DAT_EVEN) are rearranged into time-serial image data (DAT_OUT) in which the odd-numbered pixels and the even-numbered pixels are arrayed in proper order. The image data (DAT_OUT) is transferred from the multiplexer 117 to the PWM circuit 55B.

The flag generator 120 generates, as in the first embodiment, flags indicating the states of the memories 113, 114 as follows:

The operation and advantages of this embodiment will be described below while laying a focus on the delay control circuit 110A.

Figure 8:
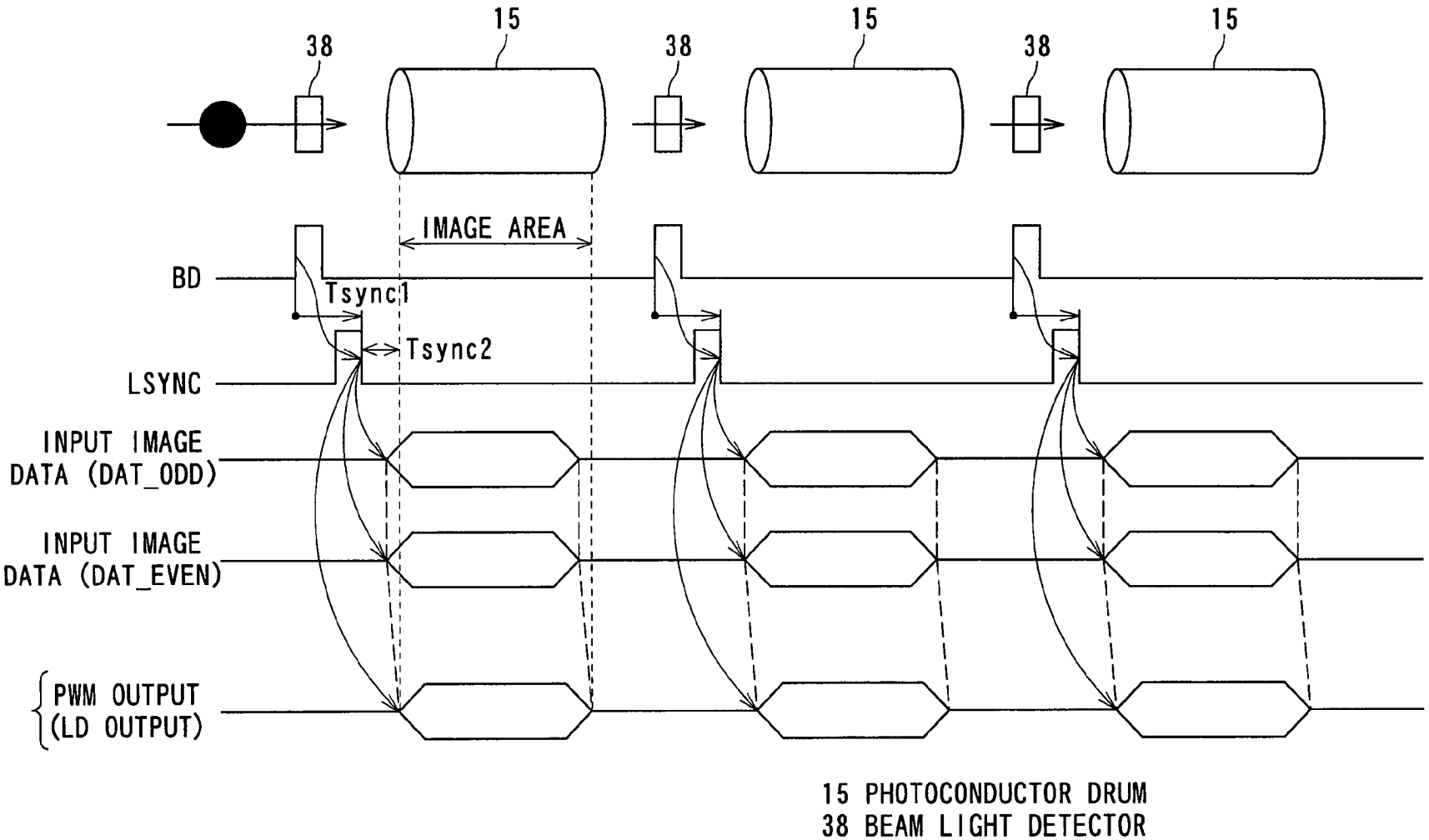
FIG. 8 is a timing chart for explaining the concept of delay control executed in the second embodiment.

FIG. 8 shows time relationships among the BD signal, the LSYNC signal, the image data (DAT_ODD, DAT_EVEN) before delay, and the PWM output (PWM modulated signal, i.e., driving signal) resulting from the image data after delay when the beam light reflected by the polygon mirror 35 scans the image area on the photoconductor drum 15.

Figure 9:
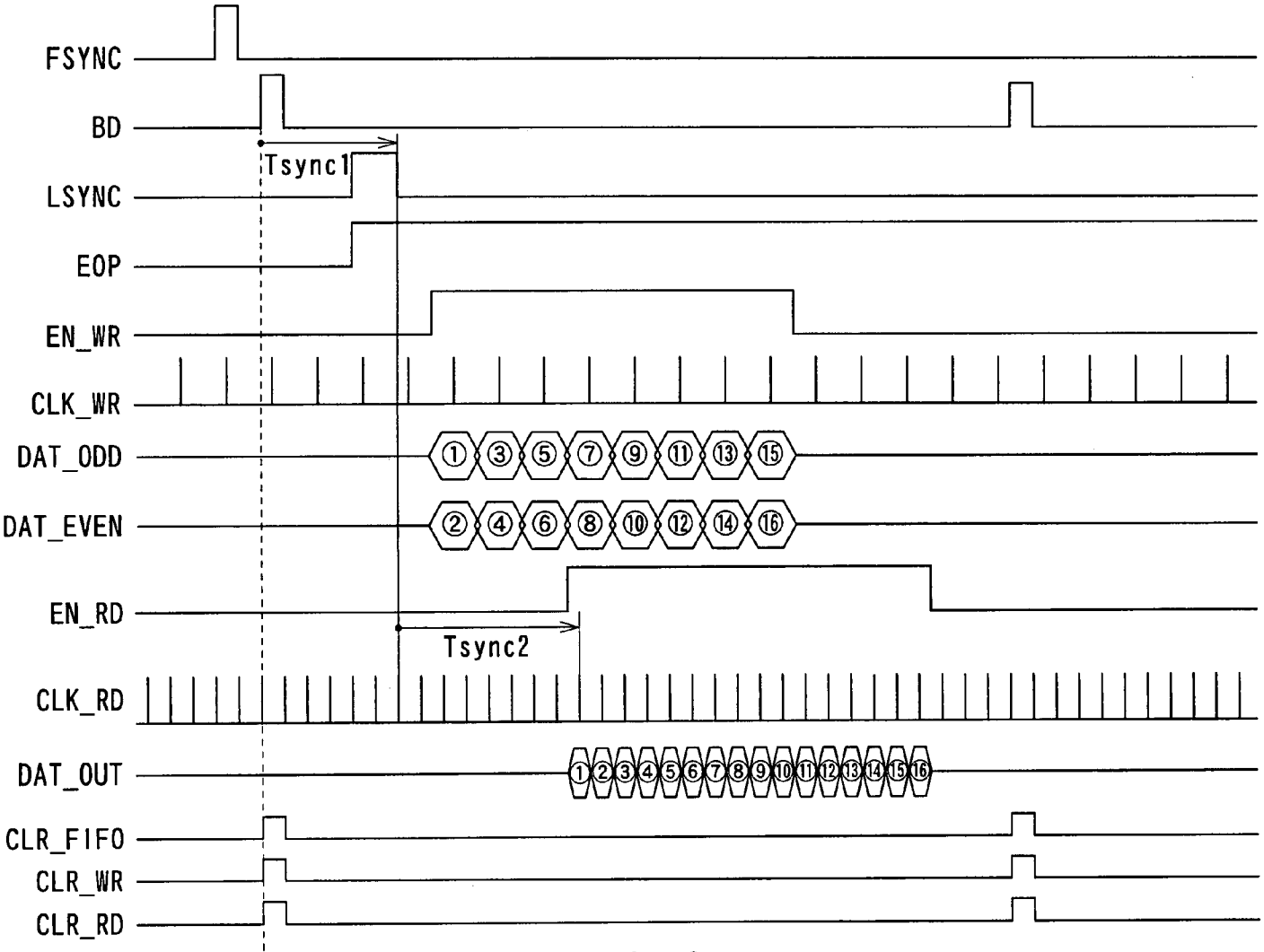
FIG. 9 is a timing chart for explaining details of the delay control executed in the second embodiment.
Figure 10:
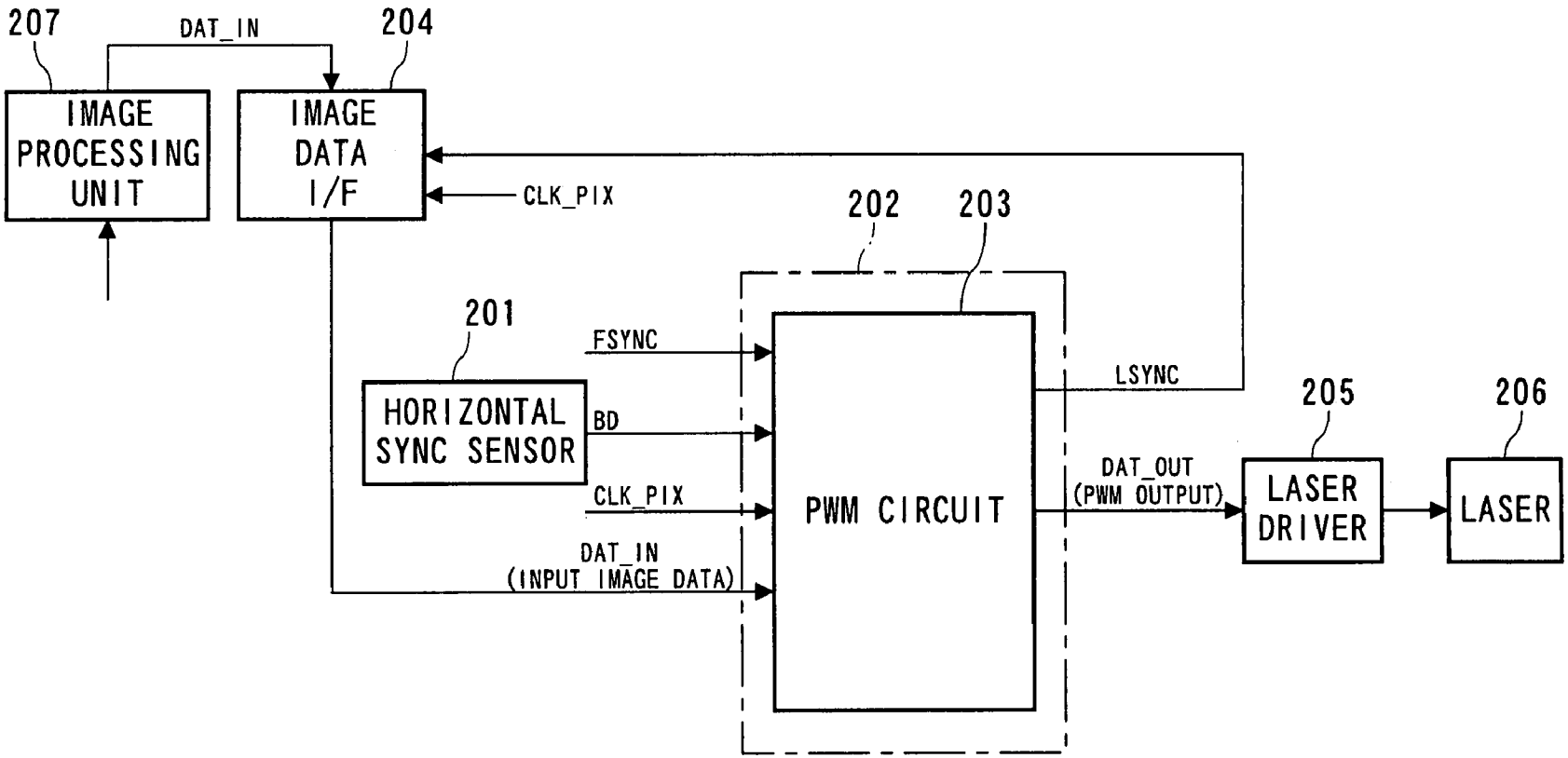
FIG. 10 is a block diagram for explaining the configuration of a laser control unit in a control system of a known copying machine.
Figure 11:
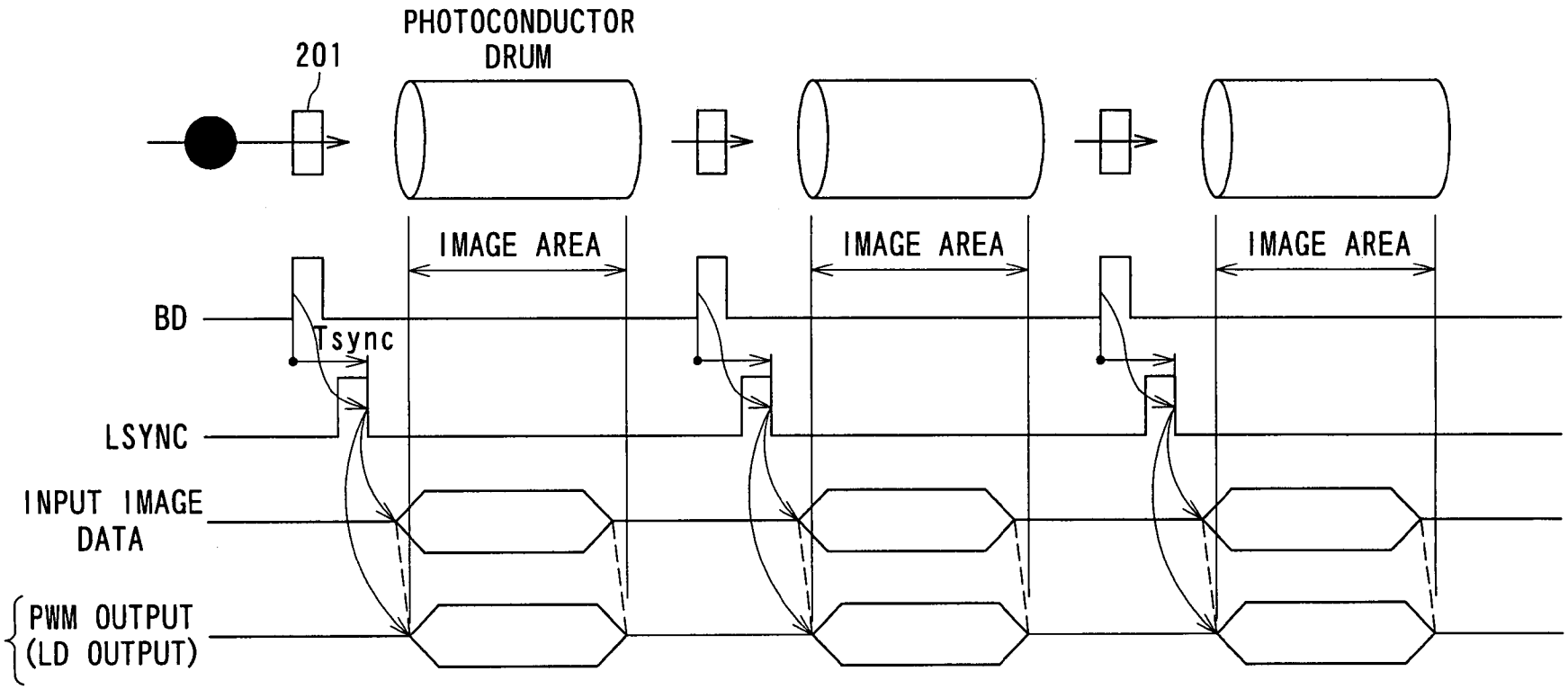
FIG. 11 is a timing chart for explaining the concept of delay control in the related art.
Figure 12:
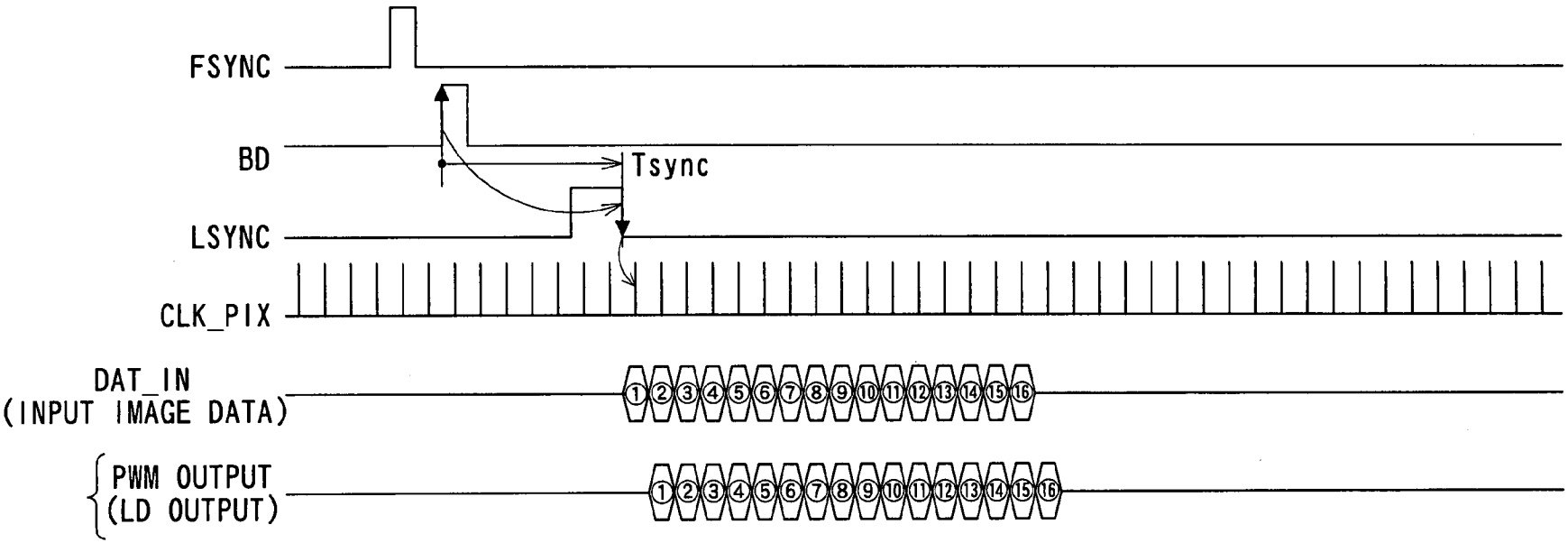
FIG. 12 is a timing chart for explaining details of the delay control executed in the related art.

The time relationships shown in FIG. 8 can be depicted in more detail as a timing chart of FIG. 9. The following description is made with reference to FIGS. 8 and 9, as well as the block diagram of FIG. 7.

As shown in FIG. 9, upon receiving the BD signal, the PWM circuit 110B outputs the LSYNC signal (line sync signal) to the image data I/F 109 in sync with the BD signal (horizontal sync signal). Upon receiving the LSYNC signal, the image data I/F 109 makes the write enable signal (EN_WR) effective for writing the data into the FIFO memories 113, 114. Correspondingly, the image data I/F 109 transfers the odd-numbered pixel image data (DAT_ODD) and the even-numbered pixel image data (DAT_EVEN) to the first and second data latches 111, 112 for the FIFO memories 113, 114 at the same time in parallel, respectively, in sync with the data transfer clock (CLK_WR) that is in turn in sync with the LSYNC signal.

The first and second data latches 111, 112 latch the data in response to the data transfer clock (data write clock: CLK_WR). In this embodiment, CLK_WR=50 MHz is set.

The writing pointer 118 executes writing of input data into memories in such a manner that the data latched by the first and second data latches 111, 112 are written into the first and second memories 113, 114. More specifically, the odd-numbered pixel image data (DAT_ODD) is written into the first memory 113, and the even-numbered pixel image data (DAT_EVEN) is written into the second memory 114. The writing pointer 118 manages the number and order of the written data.

On the other hand, the reading pointer 119 executes management of read of the data having been written into the first and second memories 113, 114 (regarding the number and order of the read data). In this embodiment, the read data clock (CLK_RD) corresponds to an image formation clock. As one example, CLK_RD=100 MHz is set. The memory capacity of each of the first and second memories 113, 114 has a maximum value of, e.g., 256 pixels.

When the image data I/F 109 outputs the read enable signal (EN_RD) in sync with the LSYNC signal, the read data clock (CLK_RD) in sync with the LSYNC signal is applied to the reading pointer 119. Responsively, the reading pointer 119 reads the image data, which have been temporarily stored in the first and second memories 113, 114, in the same order as the written data via the first and second data latch circuits 115, 116, respectively. The read image data are sent to the multiplexer 117 while remaining separated to the odd-numbered pixel image data (DAT_ODD) and the even-numbered pixel image data (DAT_EVEN). In the multiplexer 117, those data are combined with each other. Subsequently, the combined image data is transferred to the PWM circuit 110B.

Thus, as in the first embodiment, a delay amount of the read data can be adjusted by controlling the timing at which the read enable signal (EN_RD) is outputted, exactly speaking, the timing at which the read data clock (CLK_RD) is made effective by the reading pointer 119 (i.e., a delay time Tsync2 set for the same line when the data are read out of the first and second memories 113, 114 storing the odd-numbered pixel data train and the even-numbered pixel data train, respectively). As a result, similar advantages to those in the first embodiment can be obtained.

As another advantage, since writing and delayed reading of the image data are executed in two channels divided corresponding to the image data of the odd-numbered pixel train and the even-numbered pixel train, the processing speed in the upstream-side system including the image data I/F 56 is reduced half on condition that the processing speed in the system downstream of the PWM circuit 55B, which actually forms an image, is the same. Thus, the computation load is reduced. In such a case, the upstream-side system appears from a pseudo aspect such that it can maintain the same processing speed as the downstream-side system. In other words, even when the frequency of the image formation clock is further sped up with the "higher printing speed" and "finer image resolution", the processing speed in the upstream-side system can be kept relatively low. Therefore, the above advantage leads to still another advantage that the computation load of the upstream-side system including the image processing unit and the image data I/F is not required to be so increased regardless of demands for the speedup and the finer resolution.

Note that the present invention is not limited to the above-described embodiments, and can be carried out in various forms without departing from the scope of the present invention set forth in claims, as required, in combinations with the known related art.

This application claims priority from Japanese Patent Application 2005-069856, filed Mar. 11, 2005, which is incorporated herein by reference in its entirety.

What is claimed is:

1. A beam light scanning apparatus comprising:

a light emitting unit configured to emit a beam light for scan;

an image data supplying unit configured to process and supply image data of a target image in each line in a direction of main scan in response to a sync signal;

a delayed acquisition unit configured to acquire the image data supplied from the image data supplying unit after a certain time from generation of the sync signal; and a control unit configured to control operation of the light emitting means by a driving signal which is generated based on the image data outputted from the delayed acquisition unit, wherein the delayed acquisition unit comprises:

two first-in, first-out memory memories for separately storing the image data of odd-numbered pixels and even-numbered pixels in each line, a writing unit configured to write the image data supplied from the image data supplying unit into the two memories in a manner separated into the odd-numbered pixels and the even-numbered pixels, and a reading unit configured to read the image data written in the two memories after the certain time in a manner separated into the odd-numbered pixels and the even-numbered pixels, and a combining unit configured to combine the image data of the odd-numbered pixels and the even-numbered pixels read by the reading unit into image data having the same order as an original data train, wherein a frequency of a write data clock of the two memories is a half of a frequency of a data read clock of the two memories, and wherein a writing pointer and a reading pointer of the two memories are cleared whenever one line has been formed in synchronism with the sync signal.

2. The beam light scanning apparatus according to claim 1, wherein the light emitting unit is a semiconductor laser oscillator generating a laser beam light as the beam light.

3. An image forming apparatus comprising:

a beam light scanning apparatus according to claim 2;

an image carrier scanned by a beam light emitted from the light emitting unit and forming a latent image thereon; and a developing unit configured to develop the latent image formed on the image carrier.

4. The beam light scanning apparatus according to claim 1, wherein the control unit includes a PWM circuit for producing the driving signal which is subjected to PWM based on the image data outputted from the delayed acquisition unit.

5. An image forming apparatus comprising:

a beam light scanning apparatus according to claim 4;

an image carrier scanned by a beam light emitted from the light emitting unit and forming a latent image thereon; and a developing unit configured to develop the latent image formed on the image carrier.

6. The beam light scanning apparatus according to claim 1, wherein the control unit comprises a PWM circuit for producing the driving signal which is subjected to PWM based on the image data outputted from the delayed acquisition unit, and a driver for operating the light emitting unit by the driving signal produced by the PWM circuit.

7. An image forming apparatus comprising:

a beam light scanning apparatus according to claim 6;

an image carrier scanned by a beam light emitted from the light emitting unit and forming a latent image thereon; and a developing unit configured to develop the latent image formed on the image carrier.

8. An image forming apparatus comprising:

a beam light scanning apparatus according to claim 1;

an image carrier scanned by a beam light emitted from the light emitting unit and forming a latent image thereon; and a developing unit configured to develop the latent image formed on the image carrier.

9. A beam light scanning method comprising:

processing and supplying image data of a target image in each line in a direction of main scan in response to a sync signal;

acquiring the supplied image data after a certain time from generation of the sync signal; and controlling operation of light emitting means, which emits a beam light for scan, by a driving signal generated based on the acquired image data, wherein the acquiring the supplied image data after a certain time comprises:

writing the image data into two first-in, first-out memories for separately storing the image data of odd-numbered pixels and even-numbered pixels in each line, reading the image data written into two memories after the certain time in a manner separated into the odd-numbered pixels and the even-numbered pixels in each line, and combining the image data of the odd-numbered pixels and the even-numbered pixels read in the reading into image data having the same order as an original data train, wherein a frequency of a write data clock of the two memories is a half of a frequency of a data read clock of the two memories, and wherein a writing pointer and a reading pointer of the two memories are cleared whenever one line has been formed in synchronism with the sync signal.

* * * * *